US007553074B2

(12) United States Patent
Liu et al.

(10) Patent No.: US 7,553,074 B2
(45) Date of Patent: Jun. 30, 2009

(54) PERFORMANCE TESTING APPARATUS FOR HEAT PIPES

(75) Inventors: Tay-Jian Liu, Tu-Cheng (TW); Chih-Hsien Sun, Tu-Cheng (TW); Chao-Nien Tung, Tu-Cheng (TW); Chuen-Shu Hou, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 228 days.

(21) Appl. No.: 11/309,391

(22) Filed: Aug. 3, 2006

(65) Prior Publication Data

US 2007/0160111 A1 Jul. 12, 2007

(30) Foreign Application Priority Data

Jan. 10, 2006 (CN) ..... 2006 1 0032904

(51) Int. Cl.
*G01K 1/16* (2006.01)
*G01K 25/00* (2006.01)

(52) U.S. Cl. ..... 374/44; 374/29; 374/137; 374/208; 374/5; 374/57; 374/147

(58) Field of Classification Search ..... 374/4, 374/5, 29–32, 39, 43–44, 57, 137, 152, 153, 374/141, 145, 147, 179, 208
See application file for complete search history.

(56) References Cited

U.S. PATENT DOCUMENTS 3,142,983 A * 8/1964 Dudley et al. ..... 374/29
4,826,327 A * 5/1989 Michell ..... 374/20
5,168,921 A * 12/1992 Meyer, IV ..... 165/104.14
5,248,198 A * 9/1993 Droege ..... 374/7
5,355,683 A * 10/1994 Taylor ..... 62/51.1
5,409,055 A * 4/1995 Tanaka et al. ..... 165/104.33
6,883,594 B2 * 4/2005 Sarraf et al. ..... 165/104.33
7,147,368 B2 * 12/2006 Chien ..... 374/147
7,304,848 B2 * 12/2007 Chang ..... 361/701
2005/0274495 A1 * 12/2005 Wang et al. ..... 165/104.26
2006/0216561 A1 * 9/2006 Chien et al. ..... 429/26
2007/0006995 A1 * 1/2007 Lin ..... 165/104.26

* cited by examiner

*Primary Examiner*—Gail Verbitsky
(74) *Attorney, Agent, or Firm*—Frank R. Niranjan

(57) ABSTRACT

A performance testing apparatus for a heat pipe includes an immovable portion having a heating member located therein for heating an evaporating section of the heat pipe, and a movable portion capable of moving relative to the immovable portion. A receiving structure is defined between the immovable portion and the movable portion for receiving the evaporating section of the heat pipe therein. A positioning structure extends from the immovable portion and slideably receives the movable portion therein for avoiding the movable portion from deviating from the immovable portion during movement of the movable portion relative the immovable portion. Temperature sensors are attached to the immovable portion and the movable portion for detecting temperature of the heat pipe. An enclosure encloses the immovable portion and the movable portions therein, and defines a space therein for movement the movable portion relative to the immovable portion.

18 Claims, 6 Drawing Sheets

PERFORMANCE TESTING APPARATUS FOR HEAT PIPES

FIELD OF THE INVENTION

The present invention relates generally to testing apparatuses, and more particularly to a performance testing apparatus for heat pipes.

DESCRIPTION OF RELATED ART

It is well known that a heat pipe is generally a vacuum-sealed pipe. A porous wick structure is provided on an inner face of the pipe, and phase changeable working media employed to carry heat is included in the pipe. Generally, according to where the heat is input or output, a heat pipe has three sections, an evaporating section, a condensing section and an adiabatic section between the evaporating section and the condensing section.

In use, the heat pipe transfers heat from one place to another place mainly by exchanging heat through phase change of the working media. Generally, the working media is a liquid such as alcohol or water and so on. When the working media in the evaporating section of the heat pipe is heated up, it evaporates, and a pressure difference is thus produced between the evaporating section and the condensing section in the heat pipe. The resultant vapor with high enthalpy rushes to the condensing section and condenses there. Then the condensed liquid reflows to the evaporating section along the wick structure. This evaporating/condensing cycle continually transfers heat from the evaporating section to the condensing section. Due to the continual phase change of the working media, the evaporating section is kept at or near the same temperature as the condensing section of the heat pipe. Heat pipes are used widely owing to their great heat-transfer capability.

In order to ensure the effective working of the heat pipe, the heat pipe generally requires testing before being used. The maximum heat transfer capacity (Qmax) and the temperature difference ($\Delta T$) between the evaporating section and the condensing section are two important parameters in evaluating performance of the heat pipe. When a predetermined quantity of heat is input into the heat pipe through the evaporating section thereof, thermal resistance (Rth) of the heat pipe can be obtained from $\Delta T$, and the performance of the heat pipe can be evaluated. The relationship between these parameters Qmax, Rth and $\Delta T$ is $Rth=\Delta T/Qmax$. When the input quantity of heat exceeds the maximum heat transfer capacity (Qmax), the heat cannot be timely transferred from the evaporating section to the condensing section, and the temperature of the evaporating section increases rapidly.

A typical method for testing the performance of a heat pipe is to first insert the evaporating section of the heat pipe into a liquid at constant temperature; after a period of time the temperature of the heat pipe will become stable, then a temperature sensor such as a thermocouple, a resistance thermometer detector (RTD) or the like can be used to measure $\Delta T$ between the liquid and the condensing section of the heat pipe to evaluate the performance of the heat pipe. However, Rth and Qmax can not be obtained by this test, and the performance of the heat pipe can not be reflected exactly by this test.

Referring to FIG. 6, a related performance testing apparatus for heat pipes is shown. The apparatus has a resistance wire 1 coiling round an evaporating section 2*a* of a heat pipe 2, and a water cooling sleeve 3 functioning as a heat sink and enclosing a condensing section 2*b* of the heat pipe 2. In use, electrical power controlled by a voltmeter and an ammeter flows through the resistance wire 1, whereby the resistance wire 1 heats the evaporating section 2*a* of the heat pipe 2. At the same time, by controlling flow rate and temperature of cooling liquid entering the cooling sleeve 3, the heat input at the evaporating section 2*a* can be removed from the heat pipe 2 by the cooling liquid at the condensing section 2*b*, whereby a stable operating temperature of adiabatic section 2*c* of the heat pipe 2 is obtained. Therefore, Qmax of the heat pipe 2 and $\Delta T$ between the evaporating section 2*a* and the condensing section 2*b* can be obtained by temperature sensors 4 at different positions on the heat pipe 2.

However, in the test, the related testing apparatus has the following drawbacks: a) it is difficult to accurately determine lengths of the evaporating section 2*a* and the condensing section 2*b* which are important factors in determining the performance of the heat pipe 2; b) heat transference and temperature measurement may easily be affected by environmental conditions; and, c) it is difficult to achieve sufficiently intimate contact between the heat pipe and the heat source and between the heat pipe and the heat sink, which results in uneven performance test results of the heat pipe. Furthermore, due to awkward and laborious assembly and disassembly in the test, the testing apparatus can be only used in the laboratory, and can not be used in the mass production of heat pipes.

In mass production of heat pipes, a large number of performance tests are needed, and the apparatus is used frequently over a long period of time; therefore, the apparatus not only requires good testing accuracy, but also requires easy and accurate assembly to the heat pipes to be tested. The testing apparatus affects the yield and cost of the heat pipes directly; therefore, testing accuracy, facility, speed, consistency, reproducibility and reliability need to be considered when choosing the testing apparatus. Therefore, the testing apparatus needs to be improved in order to meet the demand for mass production of heat pipes.

What is needed, therefore, is a high performance testing apparatus for heat pipes suitable for use in mass production of heat pipes.

SUMMARY OF THE INVENTION

A performance testing apparatus for a heat pipe in accordance with a preferred embodiment of the present invention comprises an immovable portion having a heating member located therein for heating an evaporating section of the heat pipe, and a movable portion capable of moving relative to the immovable portion. A receiving structure is defined between the immovable portion and the movable portion for receiving an evaporating section of the heat pipe therein. A positioning structure extends from at least one of the immovable portion and the movable portion for avoiding the movable portion from deviating from the immovable portion during movement of the movable portion relative the immovable portion to ensure the receiving structure being capable of precisely receiving the heat pipe. At least one temperature sensor is attached to at least one of the immovable portion and the movable portion for thermally contacting the heat pipe in the receiving structure for detecting temperature of the heat pipe. An enclosure encloses the immovable portion and the movable portions therein, and defines a space therein for movement of the movable portion relative to the immovable portion.

Other advantages and novel features will become more apparent from the following detailed description of preferred embodiments when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
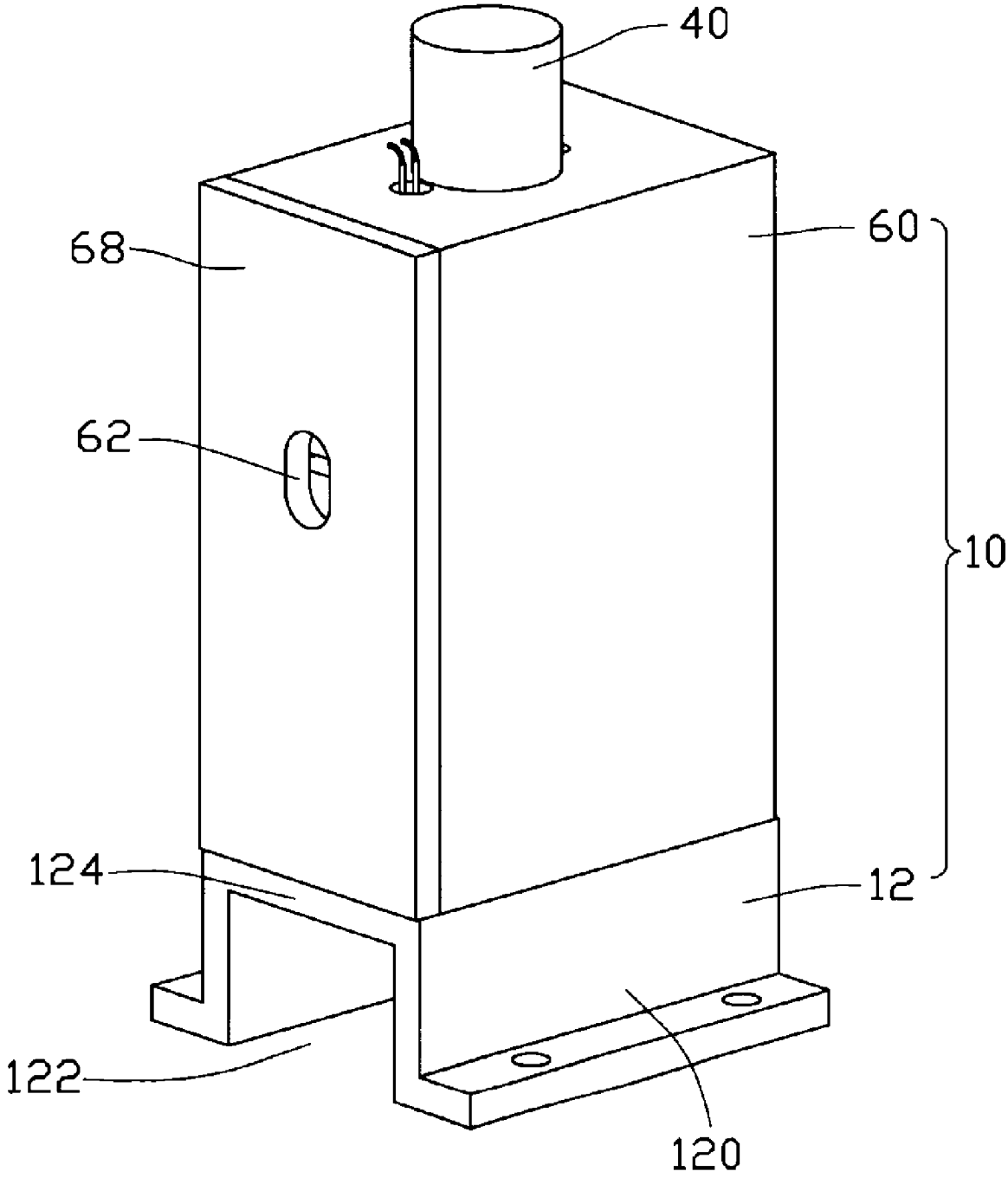
FIG. 1 is an assembled view of a performance testing apparatus for heat pipes in accordance with a preferred embodiment of the present invention.
Figure 2:
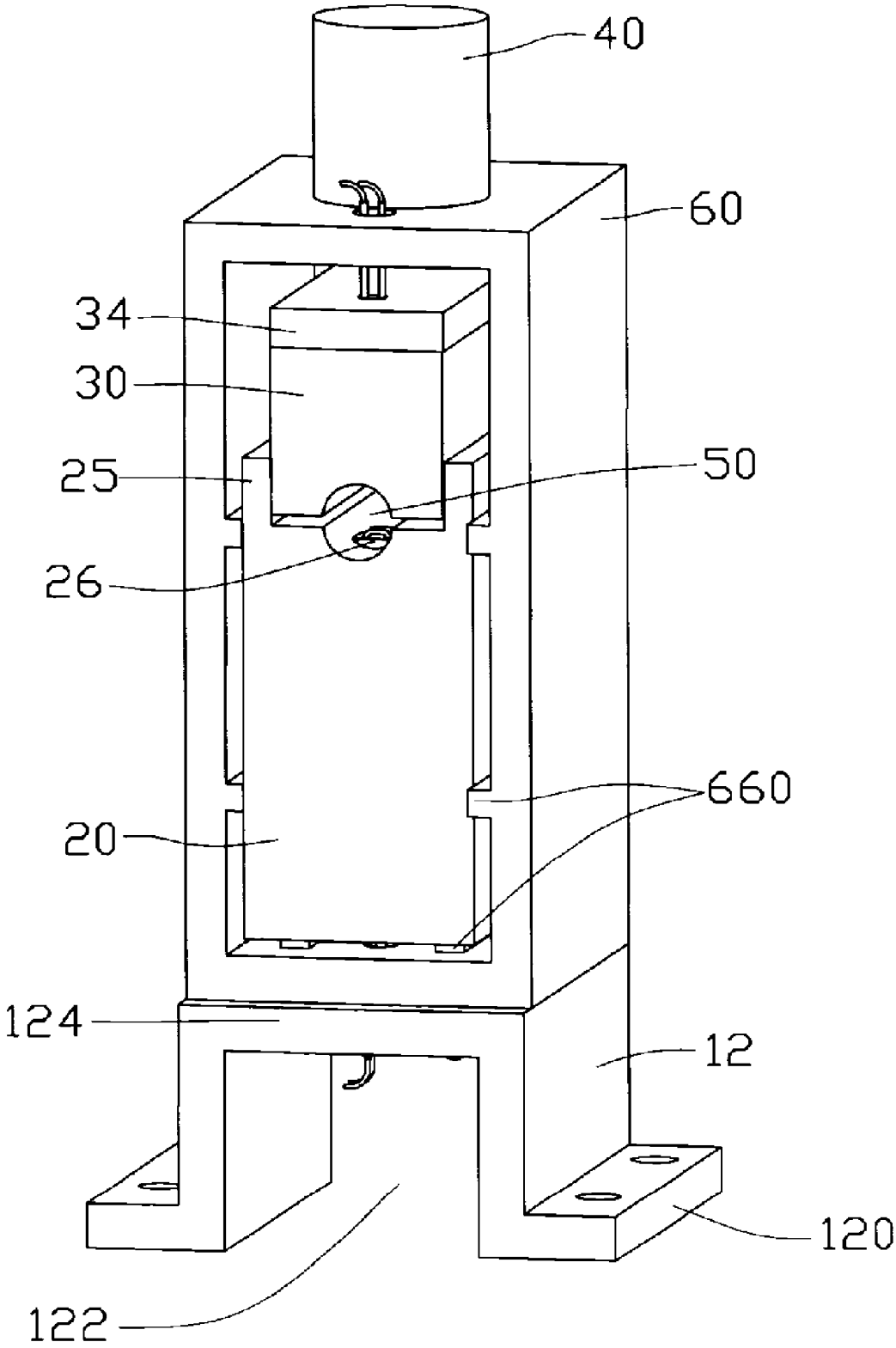
FIG. 2 shows the testing apparatus without a door board of FIG. 1.
Figure 3:
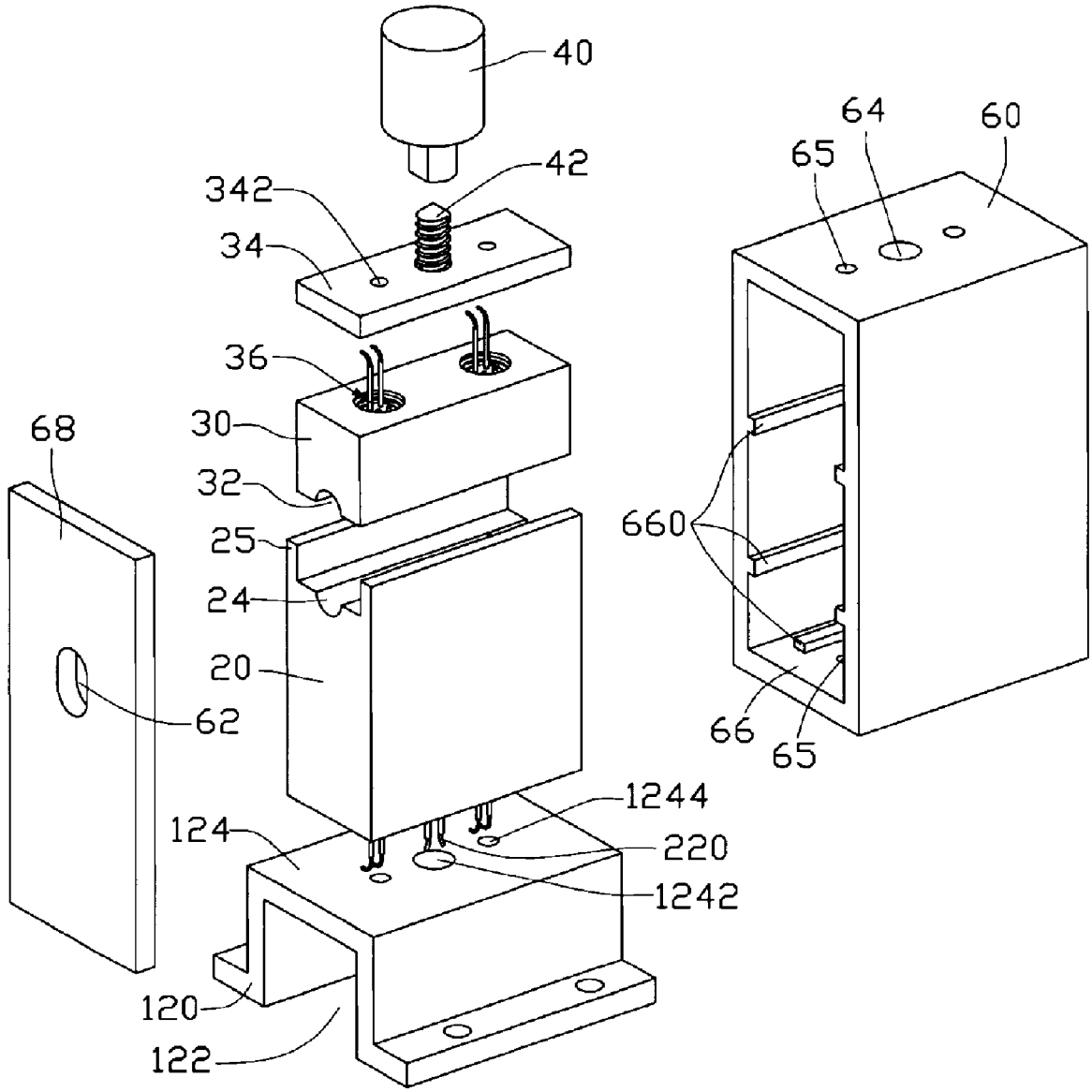
FIG. 3 is an exploded, isometric view of the testing apparatus of FIG. 1.

Referring to FIGS. 1-3, a performance testing apparatus for heat pipes in accordance with a preferred embodiment of the present invention comprises an immovable portion 20 and a movable portion 30 movably mounted on the immovable portion 20.

The immovable portion 20 is made of metal having good heat conductivity. A heating member (not shown) such as an immersion heater, resistance coil, quartz tube and Positive temperature coefficient (PTC) material or the like is embedded in the immovable portion 20. The immovable portion 20 defines a hole (not shown) through a center of a bottom thereof. In the case, the heating member is an elongated cylinder. The heating member is accommodated in the hole of the immovable portion 20 from the bottom of the immovable portion 20. Two spaced wires 220 extend from a bottom end of the heating member to connect with a power supply (not shown). The immovable portion 20 has a heating groove 24 defined in a top face thereof, for receiving an evaporating section of the heat pipe to be tested therein. Two temperature sensors 26 (only one shown) are inserted into the immovable portion 20 at two opposite sides of the heating member from the bottom of the immovable portion 20 so as to position detecting portions (not labeled and only one shown) of the sensors 26 in the heating groove 24. The detecting portions are capable of automatically contacting the heat pipe in order to detect a temperature of the evaporating section of the heat pipe.

The movable portion 30, corresponding to the heating groove 24 of the immovable portion 20, has a positioning groove 32 defined therein, whereby a testing channel 50 is cooperatively defined by the heating groove 24 and the positioning groove 32 when the movable portion 30 moves to reach the immovable portion 20. Thus, an intimate contact between the heat pipe and the movable and immovable portions 30, 20 defining the channel 50 can be realized, thereby reducing heat resistance between the heat pipe and the movable and immovable portions 30, 20. Two temperature sensors 36 are inserted into the movable portion 30 from a top thereof to reach a position wherein detecting portions (not shown) of the sensors 36 are located in the positioning groove 32. The detecting portions are capable of automatically contacting the heat pipe to detect the temperature of the evaporating section of the heat pipe.

The immovable portion 20 has two flanges 25 integrally extending upwardly from two opposite edges thereof and toward the movable portion 30. The outer face of each flange 25 is coplanar with the outer face of a main body (not labeled) of the immovable portion 20. The two flanges 25 function as positioning structure to position the movable portion 30 therebetween, which prevents the movable portion 30 from deviating from the immovable portion 20 during test of the heat pipes in mass production, thereby ensuring the grooves 24, 32 of the immovable and movable portions 20, 30 to always be aligned with each other. Thus, the channel 50 can be always precisely and easily formed for receiving the heat pipe for test. Outer faces of the movable portion 30 slideably contact the two flanges 25 of the immovable portion 20 when the movable portion 30 moves relative to the immovable portion 20. Alternatively, the movable portion 30 can have two flanges slideably engaging with two opposite sides of the immovable portion 20 to keep the immovable portion 20 aligned with the movable portion 30.

The channel 50 as shown in the preferred embodiment has a circular cross section enabling it to receive the evaporating section of the heat pipe having a correspondingly circular cross section. Alternatively, the channel 50 can have a rectangular cross section where the evaporating section of the heat pipe also has a flat rectangular configuration.

In order to ensure that the heat pipe is in close contact with the movable and immovable portions 30, 20, a supporting frame 10 is used to support and assemble the immovable and movable portions 20, 30. The immovable portion 20 is fixed on the supporting frame 10. A driving device 40 is installed on the supporting frame 10 to drive the movable portion 30 to make accurate linear movement relative to the immovable portion 20 along a vertical direction, thereby realizing the intimate contact between the heat pipe and the movable and immovable portions 30, 20. In this manner, heat resistance between the evaporating section of the heat pipe and the movable and immovable portions 30, 20 can be minimized.

The supporting frame 10 comprises a seat 12. The seat 12 comprises a supporting plate 124 at a top thereof and two feet 120 depending from the supporting plate 124. A space 122 is defined between the two feet 120 of the seat 12 for extension of wires (not labeled) of the temperature sensors 26 and the wires 220 of the heating member. The supporting plate 124 defines a central through hole 1242 and two through apertures 1244 to allow the wires 220 of the heating member and the wires of the temperature sensors 26 to extend therethrough to connect with a monitoring computer (not shown).

In order to construct a steady environment for testing the evaporating sections of the heat pipes, the supporting frame 10 further comprises a cuboidal enclosure 60 enclosing the immovable and movable portions 20, 30 therein. The enclosure 60 has a bottom 66 positioned on the supporting plate 124 of the supporting frame 10 and three interconnecting sidewalls (not labeled) extending upwardly from the bottom 66. An entrance (not labeled) is defined in an opened side of the enclosure 60 through which the movable portion 30 and the immovable portion 20 can be disposed in the enclosure 60. A door board 68 is attached to the opened side after the immovable portion 20 and the movable portion 30 are located in the enclosure 60, thereby closing the entrance and enclosing the immovable portion 20 and the movable portion 30 in the enclosure 60. Corresponding to the channel 50 between the immovable portion 20 and the movable portion 30, openings 62 (only one shown) are defined in one of the sidewalls opposite the door board 68 and the door board 68 of the enclosure 60, respectively. A pair of the sidewalls adjacent to the door board 68 and the bottom 66 each extends two spaced ribs 660. These ribs 660 position the immovable portion 20 between the pair of sidewalls and support the immovable portion 20 on the bottom 66. A ceiling (not labeled) of the enclosure 60 defines a through hole 64 for a shaft of the driving device 40 extending therethrough. Two apertures 65 are defined at two sides of the through hole 64 in the ceiling to allow wires (not labeled) of the temperature sensors 36 to extend therethrough to connect with the monitoring computer. The bottom 66 defines two through apertures 65 (only one shown) to allow the wires of the temperature sensors 26 to extend therethrough to connect with the monitoring computer, and a central hole (not shown) to allow the wire 220 of the heat member of the immovable portion 20 to extend therethrough to connect with the power supplier. The driving device 40 is fixed to the ceiling of the enclosure 60. The shaft of the driving device 40 extends through the hole 64 and threadedly engages with a bolt 42 secured to a board 34 of the movable portion 30. The board 34 is fixed atop the movable portion 30 and defines two apertures 342 through which the wires of the temperature sensors 36 extend. A space (not labeled) is left between the board 34 and the ceiling of the enclosure 60 for movement of the movable portion 30. When the driving device 40 operates, the shaft rotates, the bolt 42 with the board 34, and the movable portion 30 move upwardly or downwardly relative to the immovable portion 20 in the enclosure 60.

The driving device 40 in this preferred embodiment is a step motor, although it can be easily apprehended by those skilled in the art that the driving device 40 can also be a pneumatic cylinder or a hydraulic cylinder. In use, the driving device 40 accurately drives the movable portion 30 to move linearly relative to the immovable portion 20. For example, the movable portion 30 can be driven to depart a certain distance such as 5 millimeters from the immovable portion 20 to facilitate the insertion of the evaporating section of the heat pipe being tested into the channel 50 or withdrawn from the channel 50 after the heat pipe has been tested. On the other hand, the movable portion 30 can be driven to move toward the immovable portion 20 to thereby realize an intimate contact between the evaporating section of the heat pipe and the immovable and movable portions 20, 30 during the test. Accordingly, the requirements for testing, i.e. accuracy, ease of use and speed, can be realized by the testing apparatus in accordance with the present invention.

It can be understood that positions of the immovable portion 20 and the movable portion 30 can be exchanged, i.e., the movable portion 30 being positioned on the bottom 66 of the enclosure 60, and the immovable portion 20 being located on the movable portion 30. The driving device 40 is positioned adjacent to the immovable portion 20 and drives the immovable portion 20 move relative to the movable portion 30 in the enclosure 60. Alternatively, each of the immovable and movable portions 20, 30 have one driving device 40 installed thereon to move them toward/away from each other.

In use, the evaporating section of the heat pipe is received in the channel 50 from one of the openings 62 of the enclosure 60 when the movable portion 30 moves away from the immovable portion 20. The evaporating section of the heat pipe is put in the heating groove 24 of the immovable portion 20. Then the movable portion 30 moves along the flanges 25 to reach the top face of immovable portion 20 so that the evaporating section of the heat pipe is tightly fitted into the channel 50. The sensors 26, 36 are in thermal contact with the evaporating section of the heat pipe; therefore, the sensors 26, 36 work to accurately send detected temperatures from the evaporating section of the heat pipe to the monitoring computer. Based on the temperatures obtained by the plurality of sensors 26, 36, an average temperature can be obtained by the monitoring computer very quickly; therefore, performance of the heat pipe can be quickly decided.

Figure 4:
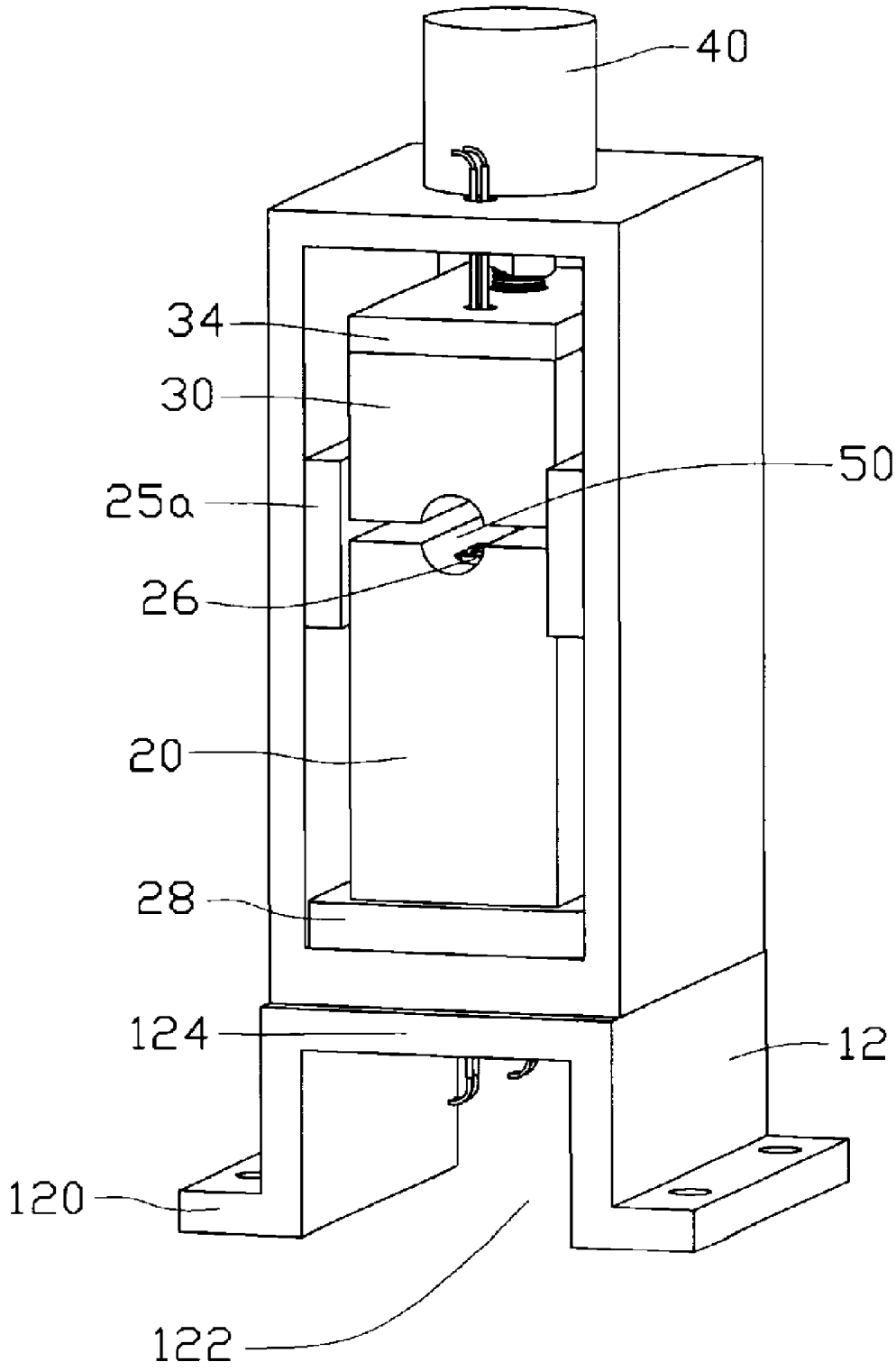
FIG. 4 is an assembled view of a performance testing apparatus for heat pipes in accordance with an alternative embodiment of the present invention.
Figure 5:
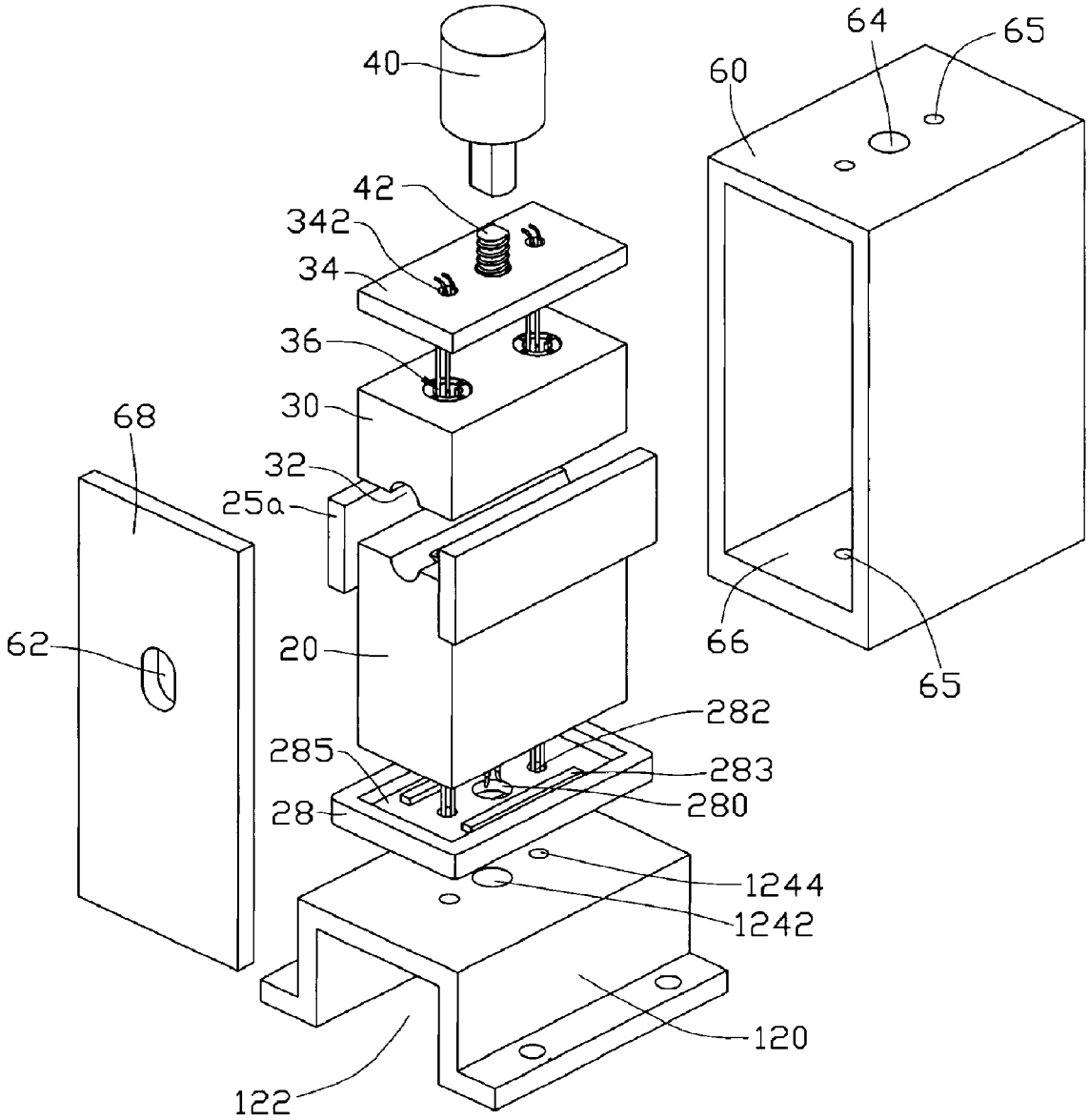
FIG. 5 is an exploded, isometric view of the testing apparatus of FIG. 4.
Figure 6:
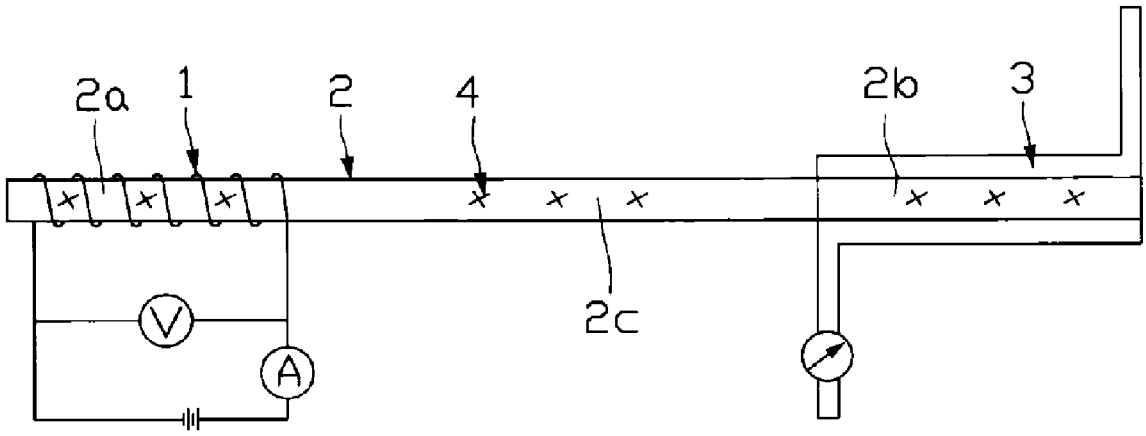
FIG. 6 (RELATED ART)
FIG. 6 is a performance testing apparatus for heat pipes in accordance with related art.

Referring to FIGS. 4 and 5, a performance testing apparatus for heat pipes in accordance with an alternative embodiment of the present invention is shown. Different from the previous preferred embodiment, the immovable portion 20 of the apparatus of the alternative embodiment has two flanges 25*a* extending toward the movable portion 30 from outer faces of the main body of the immovable portion 20. The main body of the immovable portion 20 is located between the two flanges 25*a*. The movable portion 30 is always located between the two flanges 25*a* when it moves away from or toward the immovable portion 20 during the test. The two flanges 25*a* each abuts against a corresponding sidewall of the enclosure 60 to position the immovable portion 20 between the pair of sidewalls of the enclosure 60. In order to prevent heat in the immovable portion 20 from spreading to environment, an insulating plate 28 is disposed between the immovable portion 20 and the bottom 66 of the enclosure 60. The insulating plate 28 defines a pond 285 in a top face thereof to position the bottom of the immovable portion 20 therein. Two spaced ribs 283 extend from a top of the insulating plate 28 in the pond 285 to support the immovable portion 20 to be spaced a distance from the top of the insulating plate 28. The insulating plate 28 defines a through hole 280 and two apertures 282 to allow the wires of the heating member and the wires of the temperature sensors to extend therethrough to connect with the heat source and the monitoring computer. The other structure of the alternative embodiment is substantially the same as that of the previous embodiment.

Additionally, in the present invention, in order to lower cost of the testing apparatus, the movable portion 30, the insulating plate 28, the board 34 and the enclosure 60 can be made from low-cost material such as PE (Polyethylene), ABS (Acrylonitrile Butadiene Styrene), PF(Phenol-Formaldehyde), PTFE (Polytetrafluoroethylene) and so on. The immovable portion 20 can be made from copper (Cu) or aluminum (Al). The immovable portion 20 can have silver (Ag) or nickel (Ni) plated on a top face thereof defining the heating groove 24 to prevent oxidization of the top face.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A performance testing apparatus for a heat pipe comprising:

an immovable portion having a heating member located therein for heating an evaporating section of the heat pipe;

a movable portion capable of moving relative to the immovable portion;

a receiving structure being defined between the immovable portion and the movable portion for receiving the evaporating section of the heat pipe therein; and a positioning structure extending from one of the immovable portion and the movable portion to slideably contact outer faces of the other one of the immovable portion and the movable portion for avoiding the movable portion from deviating from the immovable portion during movement of the movable portion relative the immovable portion to ensure the receiving structure being capable of precisely receiving the heat pipe;

at least one temperature sensor being attached to at least one of the immovable portion and the movable portion for thermally contacting the heat pipe in the receiving structure for detecting temperature of the heat pipe; and an enclosure enclosing the immovable portion and the movable portions therein, and defining a space therein for movement of the movable portion relative to the immovable portion.

2. The testing apparatus of claim 1, wherein the receiving structure is a channel defined between the immovable portion and the movable portion.

3. The testing apparatus of claim 2, wherein the channel is cooperatively defined by a heating groove defined in a face of the immovable portion and a positioning groove defined in a face of the movable portion, and wherein the at least a temperature sensor has a portion thereof exposed to the channel to detect the temperature of the heat pipe.

4. The testing apparatus of claim 2, wherein the positioning structure is two flanges extending from two opposite sides of the immovable portion toward the movable portion, the two flanges being capable of slideably contacting two opposite outer faces of the movable portion.

5. The testing apparatus of claim 4, wherein the movable portion is always located between the two flanges of the immovable portion when it moves away from and toward the immovable portion.

6. The testing apparatus of claim 5, wherein the two flanges each has an outer face coplanar with an outer face of a main body of the immovable portion.

7. The testing apparatus of claim 5, wherein the two flanges each extend from an outer face of a main body of the immovable portion, the main body being located between the two flanges.

8. The testing apparatus of claim 2 further comprising a seat for positioning the testing apparatus at a required position, wherein the enclosure sits on a supporting plate of the seat.

9. The testing apparatus of claim 8, wherein the seat comprises two spaced supporting feet depending from the supporting plate, a space being defined between the two feet.

10. The testing apparatus of claim 8, wherein the enclosure comprises a bottom sitting on the supporting plate of the seat, a plurality of sidewalls extending from the bottom, the immovable portion being positioned between a pair of the sidewalls.

11. The testing apparatus of claim 10, wherein the enclosure has a board attached to a side thereof, the board and the sidewalls cooperatively defines a room accommodating the immovable portion and the movable portion therein.

12. The testing apparatus of claim 11, wherein the board of the enclosure defines an opening for extension of the evaporating section of the heat pipe therethrough to be disposed in the channel.

13. The testing apparatus of claim 10, wherein the pair of the sidewalls of the enclosure each extends a plurality of ribs abutting against the immovable portion.

14. The testing apparatus of claim 10, wherein the bottom of the enclosure extends a plurality of ribs supporting the immovable portion thereon.

15. The testing apparatus of claim 10 further comprising a thermally insulating plate located between the immovable portion and a bottom of the enclosure.

16. The testing apparatus of claim 15, wherein the insulating plate defines a pond in a top face thereof, the immovable portion having a bottom thereof positioned in the pond, the pond having a plurality of ribs therein to support the immovable portion so that the immovable portion is spaced from a top face of the insulating plate defined in the pond.

17. The testing apparatus of claim 10 further comprising a driving device mounted on a ceiling of the enclosure, wherein the driving device connects with the movable portion and capable of driving the movable portion to move away from and towards the immovable portion in the enclosure.

18. The testing apparatus of claim 1, wherein the heating member is accommodated in a hole defined in the immovable portion, and has two wires extending to connect with a power supplier.

* * * * *